US011465105B2

(12) United States Patent
De Rudder et al.

(10) Patent No.: US 11,465,105 B2
(45) Date of Patent: Oct. 11, 2022

(54) MIXING DEVICE FOR MIXING A SPRAY FROM AN INJECTOR INTO A GAS AND SYSTEM COMPRISING SAME

(71) Applicant: Donaldson Company, Inc., Bloomington, MN (US)

(72) Inventors: Korneel De Rudder, Winksele (BE); Bart Schellens, Overijse (BE); Corine Chauvin, Caen (FR); Francisco Silva, Tienen (BE)

(73) Assignee: DONALDSON COMPANY, INC., Bloomington, MN (US)

( * ) Notice: Subject to any disclaimer, the term of this patent is extended or adjusted under 35 U.S.C. 154(b) by 0 days.

(21) Appl. No.: 16/964,923

(22) PCT Filed: Jan. 25, 2019

(86) PCT No.: PCT/US2019/015225
§ 371 (c)(1),
(2) Date: Jul. 24, 2020

(87) PCT Pub. No.: WO2019/147989
PCT Pub. Date: Aug. 1, 2019

(65) Prior Publication Data

US 2021/0039056 A1 Feb. 11, 2021

(30) Foreign Application Priority Data

Jan. 26, 2018 (EP) ..... 18153775

(51) Int. Cl.
*F01N 3/28* (2006.01)
*B01F 23/21* (2022.01)
(Continued)

(52) U.S. Cl.
CPC ..... *B01F 23/2132* (2022.01); *B01F 25/3141* (2022.01); *B01F 25/4315* (2022.01);
(Continued)

(58) Field of Classification Search
CPC ..... B01F 2005/0091; B01F 3/04049; B01F 5/0473; B01F 5/0616; B01F 5/0647;
(Continued)

(56) References Cited

U.S. PATENT DOCUMENTS 6,899,089 B2 * 5/2005 Shiraishi ..... F02B 47/08 123/533
9,784,163 B2 10/2017 Noren, IV et al.
(Continued)

FOREIGN PATENT DOCUMENTS

DE 102011013335 A1 9/2012
DE 112014006547 T5 12/2016
(Continued)

OTHER PUBLICATIONS

International Search Report and Written Opinion for PCT/US2019/015225, dated Jun. 21, 2019.
(Continued)

*Primary Examiner* — Phutthiwat Wongwian
*Assistant Examiner* — Diem T Tran
(74) *Attorney, Agent, or Firm* — Merchant & Gould P.C.

(57) ABSTRACT

A mixing device includes a mixing cavity having a partially open wall and a closed wall. In certain examples, the partially open wall and the closed wall are two separately formed pieces. A downstream side of the mixing device is shaped so as to define a helicoidal groove for circumferentially guiding gas from an outlet opening of the mixing cavity in a downstream direction. An injector sprays reactant into the mixing cavity.

16 Claims, 9 Drawing Sheets

(51) Int. Cl.

| | |
|---|---|
| ***B01F 25/43*** | (2022.01) |
| ***B01F 23/213*** | (2022.01) |
| ***F01N 3/20*** | (2006.01) |
| ***B01F 25/314*** | (2022.01) |
| ***B01F 25/431*** | (2022.01) |
| ***B01F 25/433*** | (2022.01) |

(52) U.S. Cl.
CPC ..... *B01F 25/4331* (2022.01); *F01N 3/2066* (2013.01); *F01N 3/2892* (2013.01); *F01N 2610/02* (2013.01); *F01N 2610/1453* (2013.01)

(58) Field of Classification Search
CPC ..... B01F 5/0688; F01N 2240/20; F01N 2470/02; F01N 2610/02; F01N 2610/1453; F01N 3/2066; F01N 3/2892
See application file for complete search history.

(56) References Cited

U.S. PATENT DOCUMENTS

| | | | | |
|---|---|---|---|---|
| 2010/0083643 | A1 | 4/2010 | Hayashi et al. | |
| 2014/0044603 | A1* | 2/2014 | Greber | F01N 3/2892 422/171 |
| 2014/0345257 | A1* | 11/2014 | Levin | B01F 3/04049 60/274 |
| 2015/0110681 | A1* | 4/2015 | Ferront | F01N 3/2892 422/168 |
| 2016/0215673 | A1* | 7/2016 | Noren, IV | B01F 5/0057 |
| 2016/0298517 | A1* | 10/2016 | Cossard | F01N 3/2066 |
| 2016/0361694 | A1 | 12/2016 | Brandt et al. | |
| 2017/0089246 | A1 | 3/2017 | Greber et al. | |

FOREIGN PATENT DOCUMENTS

| | | | |
|---|---|---|---|
| DE | 102010049018 | A1 | 4/2020 |
| EP | 3093463 | A1 | 11/2016 |
| EP | 2204556 | A1 | 7/2020 |
| WO | 2015/038897 | A1 | 3/2015 |
| WO | 2015/130789 | A1 | 9/2015 |

OTHER PUBLICATIONS

Office Action for Chinese Patent Application for 201980008662.4 (dated Jan. 19, 2022).

* cited by examiner

MIXING DEVICE FOR MIXING A SPRAY FROM AN INJECTOR INTO A GAS AND SYSTEM COMPRISING SAME

This application is a US National Stage application of PCT International Patent application No. PCT/US2019/015225, filed Jan. 25, 2019, which claims the benefit of priority to European Patent Application. Serial No. 18153775.4, filed Jan. 26, 2018, which applications are incorporated herein by reference. To the extent appropriate, a claim of priority is made to each of the above disclosed applications.

FIELD OF THE INVENTION

The present invention pertains to the field of systems for mixing a liquid spray into a gaseous flow, in particular systems for mixing a spray of urea solution into an exhaust flow of an internal combustion engine for the purpose of selective catalytic reduction (SCR) of $NO_x$ residues.

BACKGROUND

Vehicles equipped with diesel engines typically include exhaust systems that have aftertreatment components such as selective catalytic reduction catalyst devices, lean $NO_x$ catalyst devices, or lean $NO_x$ trap devices to reduce the amount of undesirable gases, such as nitrogen oxides ($NO_x$) in the exhaust. In order for these types of aftertreatment devices to work properly, a doser injects reactants, such as urea, ammonia, or hydrocarbons, into the exhaust gas. As the exhaust gas and reactants flow through the aftertreatment device, the exhaust gas and reactants convert the undesirable gases, such as NOR, into more acceptable gases, such as nitrogen, oxygen, or carbon dioxide, or into water. However, the efficiency of the aftertreatment system depends upon how evenly the reactants are mixed with the exhaust gases.

International patent application publication no. WO 2015/130789 A1 in the name of Donaldson Company, Inc., discloses an aftertreatment arrangement for treating exhaust including a main body defining an interior, an inlet opening, and an outlet; an inlet arrangement disposed at the inlet opening; an aftertreatment substrate disposed between the inlet opening and the outlet; a restrictor arrangement disposed between a first closed end of the main body interior and the aftertreatment substrate; and a dosing arrangement configured to inject reactant into the exhaust. In an example disclosed in WO 2015/130789 A1, a baffle plate defines a solid region aligned with the restricted passageway and defines openings at locations radially offset from the restricted passageway. In some particular examples, the baffle plate defines a plurality of scoops, pipes, louvers, or other direction adjusting members that facilitate swirling or other mixing movements of the exhaust.

U.S. Pat. No. 9,784,163 to Noren et al. discloses a mixer assembly that may include a mixer housing or pipe, an injector housing, a mixing bowl, a first mixing plate and a second mixing plate. The mixer housing can be generally cylindrical and may be directly or indirectly connected to a housing of the SCR catalyst. The mixer housing may include an injector opening through which the injector housing and/or the reductant injector may extend. The mixing bowl may be a generally bowl-shaped structure that may be stamped and/or otherwise formed from sheet metal, for example. The mixing bowl may include an upstream end portion, a collar portion, a step or flange portion and a downstream rim that cooperate to define a mixing chamber.

The flange portion may be disposed between the upstream end portion and the collar portion and may include the aperture through which the injector housing extends. An outer diametrical surface of the rim can be welded, fastener or pressed into engagement with the inner diametrical surface of the mixer housing, for example.

There is still a need for exhaust treatment devices that are compact and that provide more efficient and effective mixing of reactants.

SUMMARY

According to an aspect of the present invention, there is provided a mixing device for mixing a spray from an injector into a gas flowing through a substantially tubular chamber from an upstream side to a downstream side, the mixing device comprising: a partially open wall on a side upstream of the spray; and a closed wall on a side downstream of the spray; the closed wall and the partially open wall together forming a surface closed onto itself defining a mixing cavity, said mixing cavity comprising: a spray inlet opening for receiving the spray from the injector; and an outlet opening in a plane intersecting an axis of the injector. A downstream side of the mixing device is shaped so as to define a helicoidal groove for circumferentially guiding the gas from the outlet opening in a downstream direction.

The present invention is based inter alia on the insight of the inventor that a judicially shaped mixing cavity improves the mixing of a spray of reactant into a flow of exhaust gas to be treated, thus improving the effectiveness of the treatment process. The present invention is further based on the insight of the inventor that a single device defining a semi-enclosure having an open upstream side and a closed downstream side and a passage for a spray cone in a direction transverse to the upstream-downstream axis provides a very efficient and compact way to achieve the desired degree of mixing.

The shape of the mixing device (including, as the case may be, the closed wall and any surfaces that extend the closed wall) creates extra space between the mixing device and any devices downstream thereof in the same tubular chamber, specifically in the peripheral region. While it is known that forcing the gas flow (having the spray mixed therein) into a swirling motion inside the tubular chamber promotes mixing, the inventor has found that this will also cause the gas to move towards the peripheral region under the influence of the centrifugal force, and that providing extra space in this peripheral region thus promotes the desired swirling motion. It further promotes the movement of the gas from the outlet opening to the annular inlet zone of a swirl promoting means arranged downstream of the mixing device.

In an embodiment of the mixing device according to the present invention, the partially open wall is permeable to gas.

It is an advantage of this embodiment that the device substantially forms an enclosure defining a mixing cavity, while allowing gas to enter the mixing cavity from the upstream side through the permeable partially open wall.

In an embodiment of the mixing device according to the present invention, the partially open wall comprises a wall with perforations.

In a particular embodiment, at least some of the perforations are provided with louvers.

In an embodiment of the mixing device according to the present invention, the partially open wall at least partially follows a conical surface parallel with the outer boundary of the spray.

It is an advantage of this embodiment that it provides a particularly compact mixing device, as the shape of the mixing cavity is limited to the zone where the reactant spray will be present.

In an embodiment of the mixing device according to the present invention, the outlet opening is substantially perpendicular to an injection axis of the injector.

It is an advantage of this embodiment that the density of the spray impacting the outlet opening—and in particular any disperser placed therein—is made most uniform.

In an embodiment, the mixing device according to the present invention further comprises a spray disperser arranged in the outlet opening.

The spray disperser may be any structure suitable for breaking up spray droplets into smaller units in order to facilitate vaporization. It is an advantage of this embodiment that it ensures proper dispersion of the spray into the exhaust gas, by breaking up spray droplets, causing them to evaporate more easily into the gas flow. In addition, the initially conical spray pattern transitions to a more homogeneous flow pattern by passing through the spray disperser.

In a particular embodiment, the spray disperser is a mesh.

The inventor has found that a mesh, in particular a metal mesh, is a particularly effective means to disperse the spray droplets. In a more particular embodiment, the mesh comprises metal wires and/or metal plates or platelets.

In an embodiment of the mixing device according to the present invention, the closed wall bends or tapers towards the downstream side in a direction away from the spray inlet opening.

This shape of the closed wall (and optionally any surfaces that extend it) creates extra space between the mixing device and any devices downstream thereof in the same tubular chamber, specifically in the peripheral region. This space is substantially annular with a downstream component, and thus forms a helicoidal guiding channel. While it is known that forcing the gas flow (having the spray mixed therein) into a swirling motion inside the tubular chamber promotes mixing, the inventor has found that this will also cause the gas to move towards the peripheral region under the influence of the centrifugal force, and that providing extra space in this peripheral region thus promotes the desired swirling motion. It further promotes the movement of the gas from the outlet opening to the annular inlet zone of a swirl promoting means arranged downstream of the mixing device.

According to an aspect of the present invention, there is provided a mixing device for mixing a spray from an injector into a gas flowing through a substantially tubular chamber from an upstream side to a downstream side, the mixing device comprising: a mixing cavity and a mixing bowl, said mixing cavity comprising: a spray inlet opening for receiving the spray from the injector; and an outlet opening in a plane intersecting an axis of the injector; wherein said mixing cavity is arranged so that its outlet opening is in fluid communication with a corresponding outlet opening of the mixing bowl. A downstream side of the mixing bowl is shaped so as to define a helicoidal groove for circumferentially guiding the gas from the outlet opening in a downstream direction.

The shape of the mixing bowl according to this aspect of the invention creates extra space between the mixing device and any devices downstream thereof in the same tubular chamber, specifically in the peripheral region. As indicated above, providing extra space in the peripheral region promotes the desired swirling motion. It further promotes the movement of the gas from the outlet opening to the annular inlet zone of a swirl promoting means arranged downstream of the mixing bowl.

In an embodiment of the mixing device according to the present invention, the mixing cavity is formed by a mixing tube.

In a particular embodiment, the mixing tube is shaped as a cylindrical or frustoconical pipe with perforations in at least an upstream portion of its mantle, or as a cylindrically or frustoconically shaped mesh surface.

According to an aspect of the present invention, there is provided a mixing device for mixing a spray from an injector into a gas flowing through a substantially tubular chamber from an upstream side to a downstream side, the mixing device comprising: a partially open wall on a side upstream of the spray; and a closed wall on a side downstream of the spray; the closed wall and the partially open wall together forming a surface closed onto itself defining a mixing cavity, the mixing cavity comprising: a spray inlet opening for receiving a conical spray from the injector; and an outlet opening in a plane intersecting an axis of the injector. The partially open wall and the closed wall are two separately formed pieces, distinct from any wall of the substantially tubular chamber and joined together so as to form the surface closed onto itself defining the mixing cavity.

According to an aspect of the present invention, there is provided a mixing device for mixing a spray from an injector into a gas flowing through a substantially tubular chamber from an upstream side to a downstream side, the mixing device comprising: a partially open wall on a side upstream of the spray; and a closed wall on a side downstream of the spray; the closed wall and the partially open wall together forming a surface closed onto itself defining a mixing cavity, the mixing cavity comprising: a spray inlet opening for receiving a conical spray from the injector; and an outlet opening in a plane intersecting an axis of the injector. The closed wall is an integral part of a larger piece that also presents a baffle portion on either side of the mixing cavity, and a skirt portion arranged directly upstream of a space below the outlet opening.

According to an aspect of the present invention, there is provided a system for treating exhaust gas, the system comprising a substantially tubular chamber receiving a flow of exhaust gas to be treated; the mixing device as described above; and an injector arranged to inject the spray into the spray inlet opening.

The technical effects and advantages of embodiments of the system according to the present invention correspond, mutatis mutandis, to those of the corresponding embodiments of the mixing device according to the present invention.

In an embodiment of the system according to the present invention, an axis of the spray does not intersect with a longitudinal axis of the substantially tubular chamber.

In this embodiment, the axis along which the reactant spray is injected into the tubular chamber is off-center relative to the longitudinal axis of the tubular chamber. It is an advantage of this embodiment that a swirling motion of the gas-spray mixture is promoted.

In an embodiment of the system according to the present invention, the mixing device is arranged so as to substantially block any flows of gas from an upstream side of the mixing device to a downstream side of the mixing device other than flows entering the mixing device through the partially open wall and leaving the mixing device through the outlet opening.

It is an advantage of this embodiment that the dispersion of the spray into the exhaust gas flow is optimized by forcing substantially all the gas through the mixing device where the spray is injected. The term "substantially block" is meant to cover both situations where the mixing device is arranged so as to completely block any flows of gas from an upstream side of the mixing device to a downstream side of the mixing device, and situations where the gas can still bypass the mixing device to a negligible extent (e.g., through gaps left due to production tolerances or holes provided for demolding purposes) or in a controlled way (e.g., through a dedicated bypass orifice).

In an embodiment, the system according to the present invention further comprises a swirl promoting means downstream of the mixing device, and a part of the closed wall that is further removed from a longitudinal axis of the substantially tubular chamber is at a greater distance from the swirl promoting means than a part of the closed wall that is closer to the longitudinal axis of the substantially tubular chamber.

In an embodiment, the system according to the present invention further comprises a swirl promoting means downstream of said mixing device, said swirl promoting means having an annular inlet zone, wherein said mixing device is shaped so as to open up a helicoidal space between said mixing device and said swirl promoting means, said helicoidal space serving as a flow channel from said outlet opening to said annular inlet zone. The swirl promoting means may be substantially planar.

BRIEF DESCRIPTION OF THE FIGURES

These and other features and advantages of embodiments of the present invention will be described in more detail with reference to the attached drawings, in which.

Throughout the figures, like reference numerals have been used to refer to like elements.

DESCRIPTION OF EMBODIMENTS

Throughout the description of the figures, terms such as "above" and "below" are used to denote relative positions of elements of the system in the orientation in which they are depicted in the figures. The use of these terms is not meant to limit the invention to arrangements having their upside and downside oriented in this way when in use.

Throughout the following description, the term "mixing bowl" is used to denote a structure similar to the "mixing bowl" of U.S. Pat. No. 9,784,163. As stated in that publication, the mixing bowl may be a generally bowl-shaped structure that may be stamped and/or otherwise formed from sheet metal, for example. The mixing bowl could be formed by any suitable process and from any suitable material. The mixing bowl may include an upstream end portion, a collar portion, a step or flange portion and a downstream rim that cooperate to define a mixing chamber.

Figure 1:
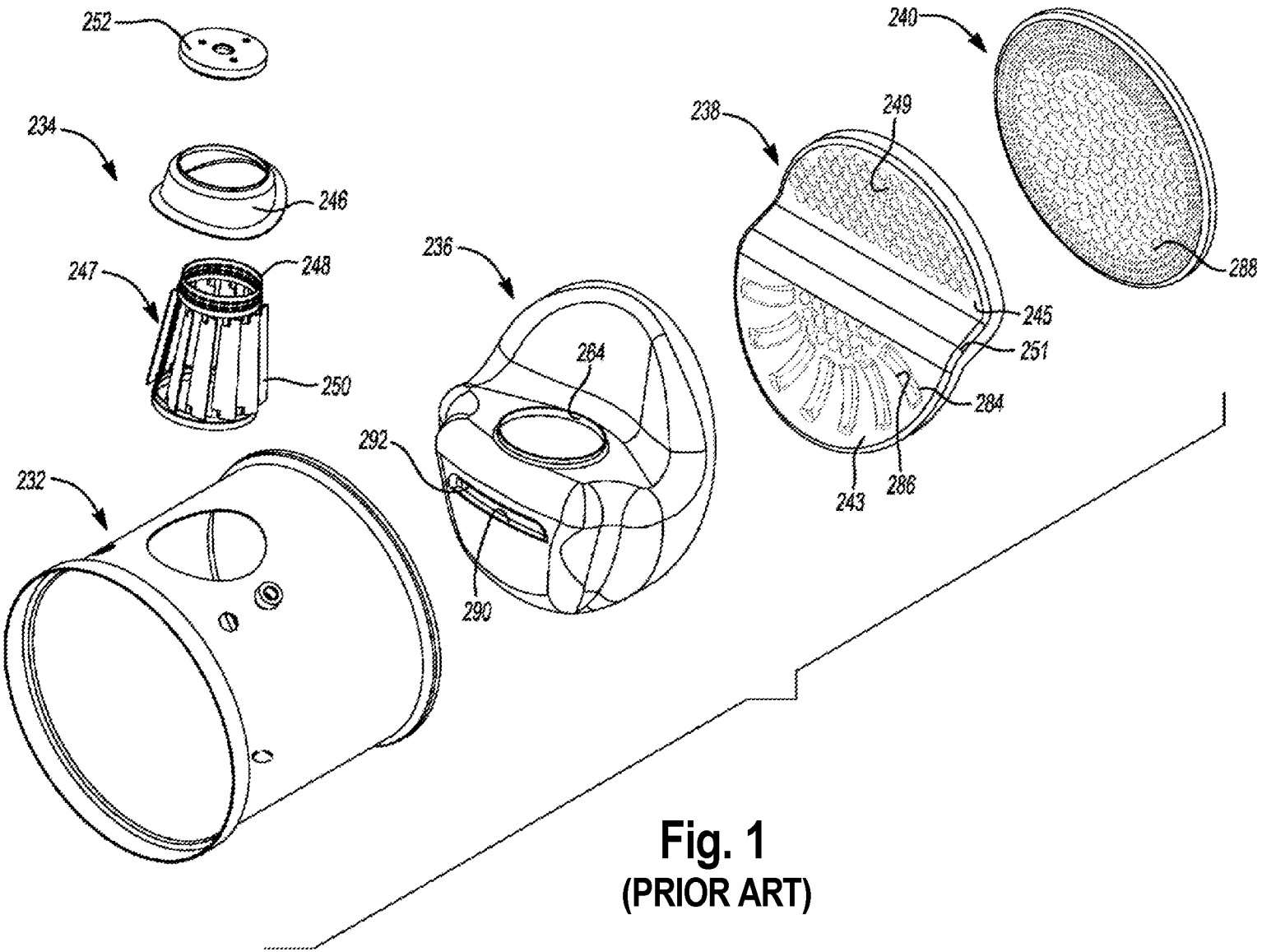
Fig. 1 (PRIOR ART)
FIG. 1 presents a mixer assembly according to the prior art.

FIG. 1 presents a mixer assembly according to the prior art. It includes a mixer housing or pipe 232, an injector housing 234, a mixing bowl 236, a first mixing plate 238 and a second mixing plate 240. Injector housing 234 includes a flange 246 coupled to a swirling device 247. Swirling device 247 includes a cylindrical portion 248 and a frustoconical portion 250. A cap 252 is fixed to flange 246 and cylindrical portion 248. Mixing bowl 236 includes an aperture 290 associated with a louver 292 extending across pipe 232 a distance approximately half of the inner diameter of the pipe. Aperture 290 and louver 292 are positioned centrally within the circular cross-section of pipe 232. Exhaust gas flows through aperture 290 and is redirected by louver 292. Exhaust gas also flows through apertures extending through cylindrical portion 248, frustoconical portion 250 to pass through aperture 264 of mixing bowl 236.

The mixing bowl 236 of the prior art does not define a single cavity closed on the downstream side and partially open on the upstream side. In particular, the prior-art mixing bowl 236 does not include a partially open wall on the upstream side, between the inlet opening 246 and the outlet opening 264. The main mixing zone is delimited by the frustoconical portion 250 of the injector housing 234, which is an open arrangement of vertical louvers on all sides. While the outer surface of the mixing bowl 236 keeps gas from passing to the downstream side without passing through either the outlet opening 264 or the aperture 290, it does not contribute to the formation of the mixing cavity.

Figure 2:
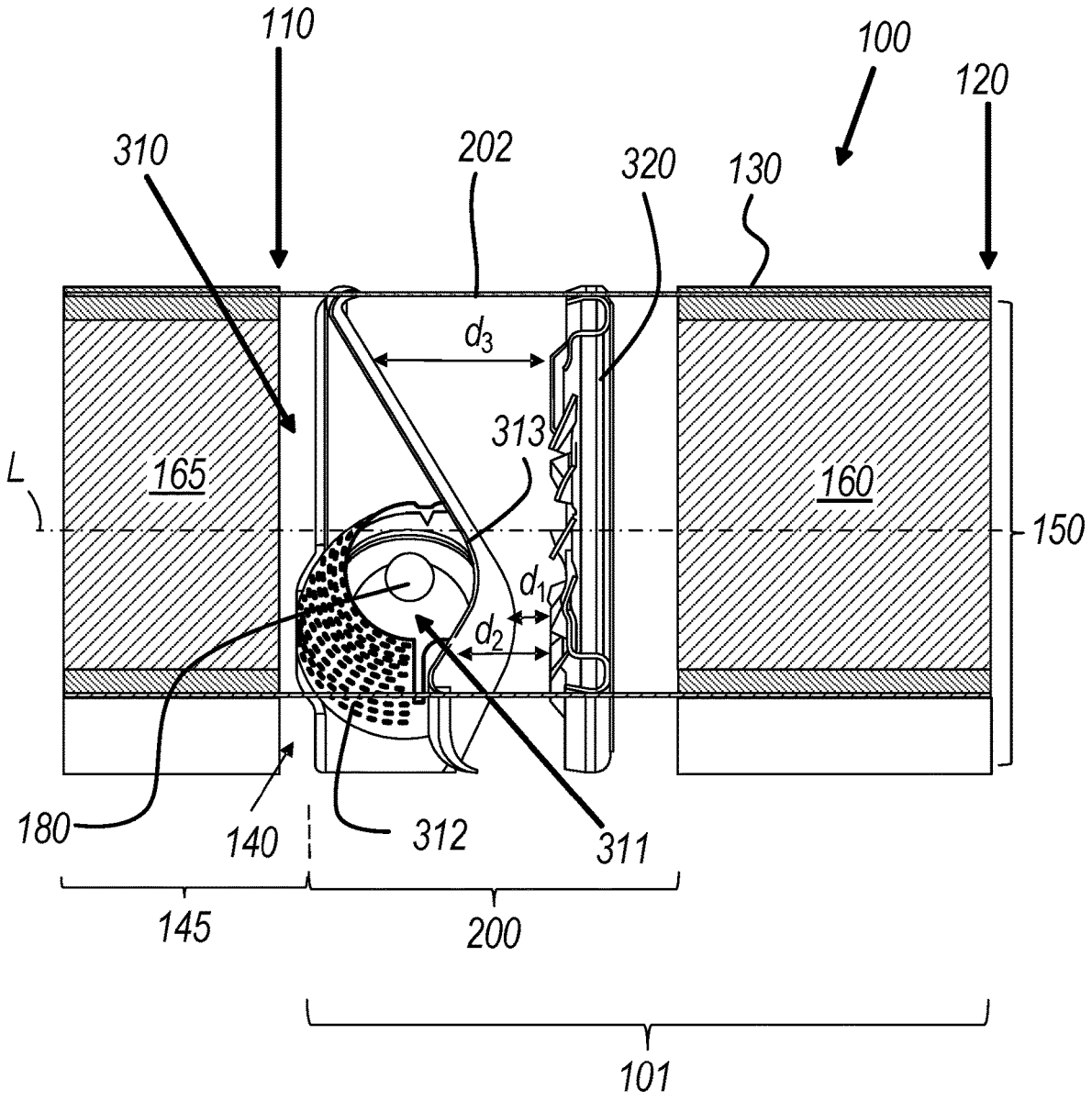
FIG. 2 presents a cross section of a system for treating exhaust gas according to a first embodiment of the present invention.

FIG. 2 presents a cross section of a system for treating an exhaust gas flow, including a mixing device according to a first embodiment of the present invention.

In a general embodiment, the system comprises a substantially tubular chamber receiving a flow of exhaust gas to be treated, a mixing device 310, and an injector arranged to inject a spray 180 into the spray inlet opening 311 of the mixing device 310. The term "substantially tubular chamber" designates any channel configured to contain a gas flowing between an inlet side and an outlet side, and is not limited to axisymmetric chambers, chambers having a constant cross-section, or chambers having other specific form properties. However, in particular embodiments, a chamber having such form properties may be chosen if the requirements of the application render a particular form desirable or appropriate.

Without loss of generality, the spray 180 is illustrated as following a conical pattern; the skilled person will appreciate that other spray shapes are possible. In particular, the actual shape of a spray originating from an injector designed to produce a conical spray may deviate from a perfect conical form due to manufacturing imperfections, gravitational pull, or due to the fact that the spray is injected from several closely-spaced orifices.

The illustrated system comprises a main body 100 defining an interior 101, the main body interior extending from a first end 110 to a second end 120. The skilled person will appreciate that the main body 100 has been given a certain length for the purpose of keeping the figure clear, the second end 120 may in reality be at a shorter or greater distance from the first end 110. The main body 100 defines a circumferential wall 130 extending between the first end and the second end; i.e., the main body interior has the nature of hollow tube or cavity. In the illustrated case, the first end 110 defines an inlet opening 140 (in a variant, not illustrated, the circumferential wall 130 defines an inlet opening). The main body 100 also defines an outlet 150.

An inlet arrangement is disposed at the inlet opening 140. The inlet arrangement defines an inlet channel 145 leading to the interior 101 of the main body 100. Through this inlet channel 145, the gaseous flow that is to be mixed with the liquid spray enters the system. In the illustrated case, an optional pre-treatment substrate 165 (e.g. a Diesel Oxidation Catalyst or a Diesel particle filter) is present in a part of the inlet channel 145.

A reaction zone 160 is disposed within the interior 101 of the main body 100 between the inlet opening 140 and the outlet 150. The reaction zone 160 is spaced from the first end 110 to define a mixing region 200 within the main body interior 101. This mixing region 200 is where the mixing of the liquid spray and the gaseous flow will take place, before the duly mixed vaporizing aerosol enters the reaction zone 160.

A restrictor arrangement (not shown in FIG. 2) may be disposed within the interior 101 of the main body 100 between the first end 110 and the reaction zone 160. Details of the optional restrictor arrangement are given in the description of FIG. 5, below.

The mixing region 200 comprises a mixing device 310, a dosing arrangement (not illustrated) configured to inject a spray 180 into said mixing device 310, and a swirl promoting means 320 arranged downstream of the mixing device 310 and the dosing arrangement 180.

The dosing arrangement is configured to receive an injector to spray reactant (e.g. an aqueous urea solution) into the gas (e.g. exhaust gas of an internal combustion engine) so that the reactant mixes with the gas in the mixing region 200. In the illustrated case, an axis S of the spray 180 does not intersect with a longitudinal axis L of the substantially tubular chamber.

The mixing device 310 is arranged so as to force the gaseous flow entering the main body interior 101 into a swirling motion before receiving the liquid spray. It substantially blocks any flows of gas from an upstream side of said mixing device 310 to a downstream side of said mixing device 310 other than flows entering the mixing device 310 through its partially open wall 312 on the upstream side and leaving the mixing device 310 through its outlet opening (not visible in FIG. 2). The partially open wall 312 also functions as a spray protector.

The partially open wall 312 and the closed wall 313 may be two separately formed pieces, distinct from any wall of the substantially tubular chamber 202 and joined together so as to form a surface closed onto itself defining the mixing cavity. The separately formed pieces may be formed of the same material, or they may be formed of different materials. For example, the partially open wall 312 may be formed of one type of metal, and the closed wall 313 may be formed of another type of metal. The separately formed pieces may be joined together by any suitable means, taking into account their material properties. The separately formed pieces may be joined indirectly, by joining each of the separately to one or more other pieces in a manner that is suitable to secure the relative positions of the separately formed pieces.

The swirl promoting means 320 is arranged between the dosing arrangement and the optional restrictor arrangement, such that a gaseous flow passing through the second swirl promoting means 320 is swirled around (whereby the droplets are forced radially outwards as a result of the centrifugal force) before optionally entering the restricted passageway.

The swirl promoting means 320 may comprise a baffle plate defining a plurality of scoops, pipes, louvers, or other direction adjusting members. Without loss of generality, the swirl promoting means 320 of FIG. 2 is formed as a baffle plate defining a plurality of louvers. Preferably, a combined open area of the plurality of openings defined by the baffle plate is at least as large as a transverse area of the optional restricted passageway. Without loss of generality, the swirl promoting means 320 of FIG. 2 is arranged in a plane perpendicular to the axis L of the main body 100, but the skilled person will appreciate that a similar effect may be obtained by means of elements placed at an angle.

Preferably, the mixing device 310 and the swirl promoting means 320 are arranged to promote swirling in a first angular direction and a second angular direction respectively, the first angular direction and the second angular direction being mutually opposed. Such an arrangement has been shown to result in better mixing of injected urea.

A part of the closed wall 312 on the downstream side of the mixing device 310 that is further removed from a longitudinal axis L of the substantially tubular chamber is at a greater distance from the swirl promoting means 320 (this refers for example to $d_2$ and $d_3$, as indicated in the figure) than a part of said closed wall 312 that is closer to the longitudinal axis L of said substantially tubular chamber ($d_1$). As a result, the peripheral zone of the space just downstream of the mixing device 310 is broader ($d_2$, $d_3$) than the central zone ($d_1$), so as to accommodate the swirling gas that tends to accumulate in the peripheral region due to the centrifugal force.

In the system illustrated in FIG. 2, the main body interior 101 extends along a longitudinal axis L from the first end 110 to the second end 120. The dosing arrangement is configured so that an injection axis S of any injector mounted to the dosing arrangement is not coaxial with the longitudinal axis L of the main body 100. However, the inventors have found that such a linear arrangement is not strictly necessary to obtain the advantages of the present invention.

Figure 3:
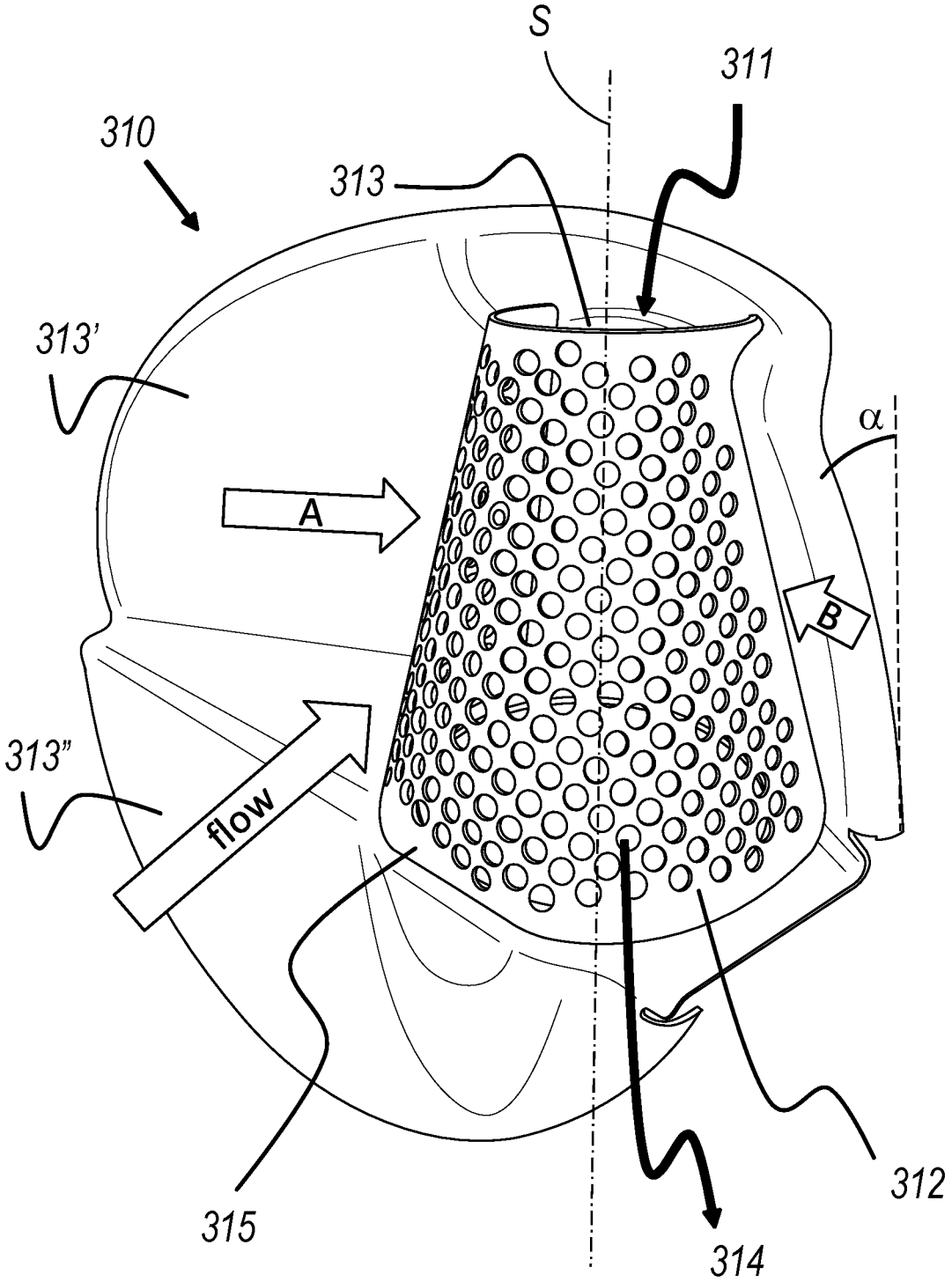
FIG. 3 presents details of the mixing device according to an embodiment of the present invention as included in FIG. 2.

Embodiments of the system according to the present invention may further comprise a directional flow expansion device disposed in the mixing region 200 (not illustrated). This directional flow expansion device may include a baffle plate defining a plurality of openings. Further details of a flow expansion device may be found in international patent application publication no. WO 2015/130789 A1 in the name of Donaldson Company, Inc., the content of which is incorporated by this reference for this purpose. FIG. 3 presents further details of the mixing device 310 according to an embodiment of the present invention, illustrated in FIG. 2 as part of the system. FIG. 3 represents a mixing device 310 for mixing a spray from an injector into a gas flowing through a substantially tubular chamber (not illustrated in FIG. 3) from an upstream side to a downstream side; the terms "upstream" and "downstream" refer to the direction of flow of the gas to be treated inside the substantially tubular chamber, indicated in FIG. 3 by the arrow marked "flow".

The mixing device 310 comprises a spray inlet opening 311 for receiving a spray (not illustrated) from the injector (not illustrated).

The mixing device 310 comprises a partially open wall 312 on a side upstream of the spray. In the illustrated case, the partially open wall 312 comprises a wall, e.g. a metal sheet, with perforations. Some or all of said perforations may be provided with louvers (not illustrated) to direct the gas flowing into the cavity in a particular direction so as to generate a swirling motion.

In the illustrated case, the partially open wall 312 at least partially follows a conical surface parallel with the outer boundary of the spray. Indeed, the perforated metal plate that serves as the partially open wall 312 generally defines a frustoconical surface, with the exception of a small flattened upstream portion 315 and the missing downstream portion which is closed by a closed wall 313, arranged on a side downstream of the spray. The closed wall 313 bends or tapers towards the upstream side in a direction approaching said spray inlet opening 311, as schematically indicated by the identification of the gap □ between the tangent of the closed wall 313 starting at a central position (dashed line) and the position of the surface of the closed wall 313 at a point closer to the inlet opening 311.

The mixing device 310 further comprises an outlet opening 314 in a plane intersecting an axis S of said injector; the axis S is indicated in FIG. 3 by a vertical dash-dotted line. In the illustrated case, the outlet opening 314 is substantially perpendicular to an injection axis S of said injector. A spray disperser (not illustrated), such as a mesh (preferably a metal mesh), may be arranged in the outlet opening 314.

The closed wall 313 and the partially open wall 312 together form a surface closed onto itself defining a mixing cavity. The injected spray enters the mixing cavity through the inlet opening 311 and leaves the mixing cavity, mixed with the gas to be treated, through the outlet opening 314. The gas to be treated enters the mixing cavity through the openings of the partially open wall 312 on the upstream side of the mixing cavity, and leaves the mixing cavity enriched with the injected spray via the outlet opening 314.

In the illustrated embodiment (and in the following embodiments), the closed wall 313 that combines with the partially open wall 312 to define the mixing cavity is an integral part of a larger piece that also presents baffle portion 313' on either side of the mixing cavity, and a skirt portion 313" arranged directly upstream of the space below the outlet opening 314. In this arrangement, the larger piece takes on the role of the mixing bowl of the prior art, so no separate mixing bowl is necessary. While this is a particularly advantageous way to implement the invention, the invention is not limited to such an integrated approach.

As the partially open wall 312 and the mixing cavity are positioned away from the center of the substantially tubular chamber and do not cover its entire width, a portion of the oncoming gas flow will hit the surface of the baffle portions 313' on either side of the mixing cavity, and will be guided towards the mixing cavity by said surface (schematically indicated by the arrows marked "A" and "B"). Being so guided, the gas will reach the portion of the partially open wall 312 near the closed wall 313 and enter the mixing cavity via the perforations in the partially open wall 312.

Figure 4:
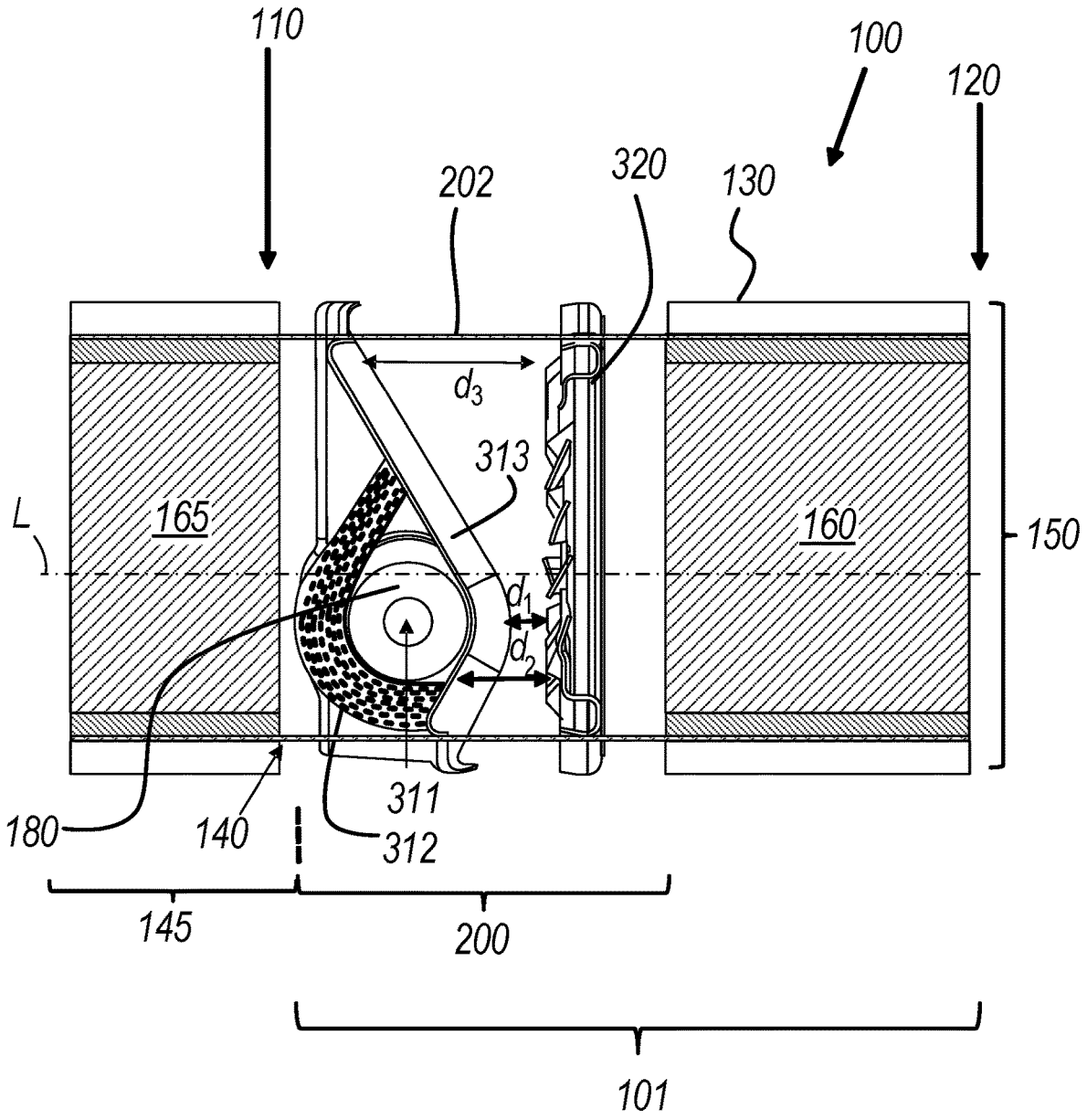
FIG. 4 presents a cross section of a system for treating exhaust gas according to a second embodiment of the present invention.

FIG. 4 presents a cross section of a system for treating exhaust gas according to a second embodiment of the present invention. The illustrated system is similar to the system of FIG. 2; like numerals have been used to designate the same or similar elements. The system of FIG. 4 is distinguished from the system of FIG. 2 by the shape of the partially open wall 312 of the mixing device 310. As before, the shape of the partially open wall 312 partially follows the conical boundary of the injected spray. However, in this case, the partially open wall 312 joins the closed wall 313 at a point further removed from the axis S of the injector. This arrangement, which deviates from the cylindrical symmetry of the first embodiment, has been found to induce a greater amount of turbulence in the gas flow, which contributes to a better mixing of the spray droplets into the gas flow.

Figure 5:
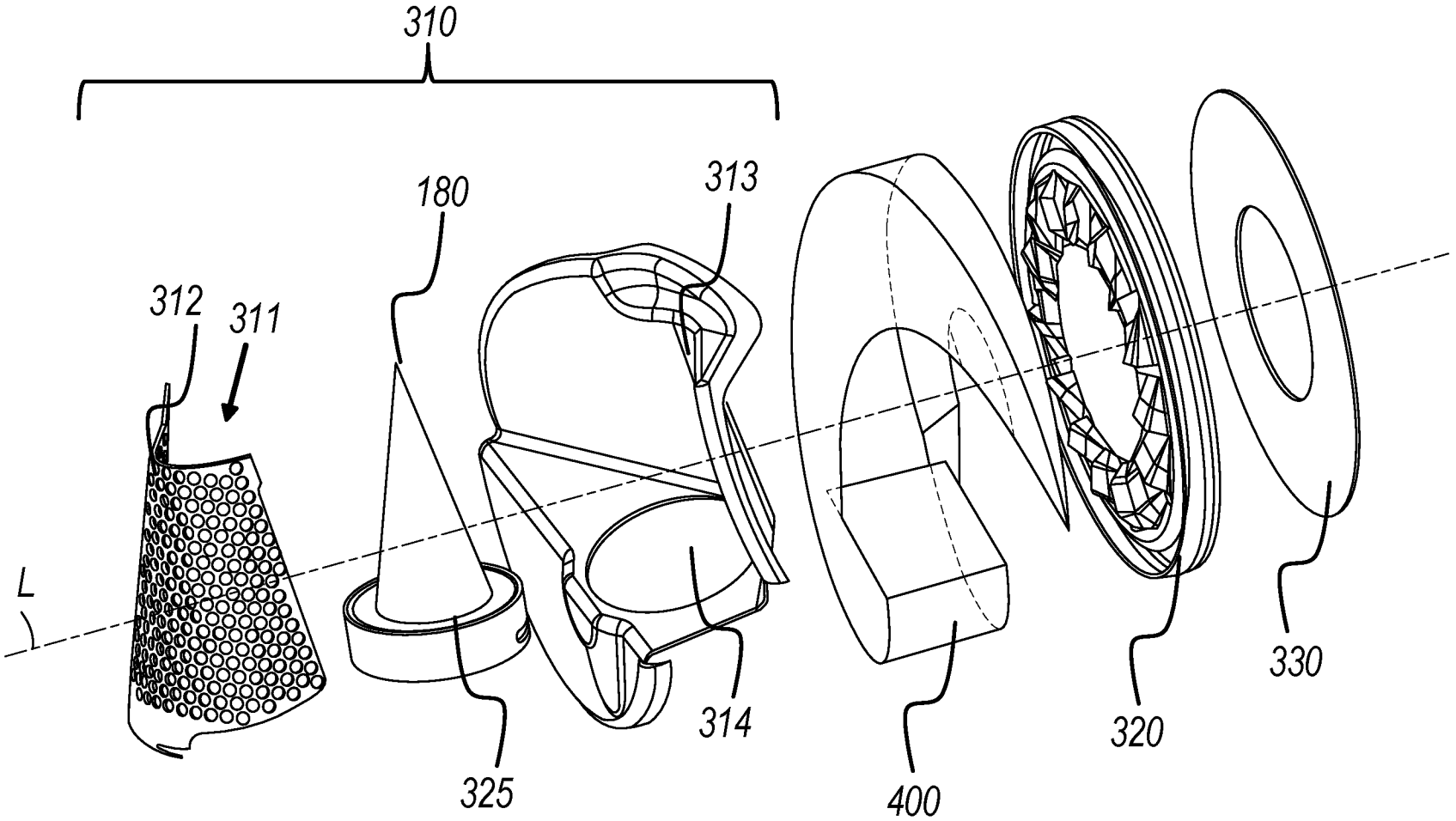
FIG. 5 presents an exploded view of a system for treating exhaust gas according to the second embodiment of the present invention.

FIG. 5 presents an exploded view of a system for treating exhaust gas according to the second embodiment of the present invention. Except where the shape of the partially open wall 312 is specifically concerned, any features, options, and advantages described in connection with FIG. 5, are equally applicable to the first embodiment of the present invention as described above.

For clarity reasons, the main body has not been shown. The reader will understand that the illustrated components fulfill their functions as described only when suitably arranged in a substantially tubular chamber that contains the gas flowing between the inlet side and the outlet side. As above, the terms "upstream" and "downstream" refer to the direction of flow of the gas to be treated inside the substantially tubular chamber (i.e., from left to right in the illustrated orientation).

The dosing arrangement is preferably configured so that an injection axis S of any injector mounted to the dosing arrangement is not coaxial with the longitudinal axis L of the main body.

The optional directional flow expansion device which may be present in the mixing region is not illustrated.

The components shown on the left-hand side of FIG. 5 combine to form a mixing device 310 for mixing a spray 180 from an injector into a gas flowing through the substantially tubular chamber from an upstream side to a downstream side. Without loss of generality, the spray 180 is illustrated as a conical spray.

When assembled, the mixing device 310 comprises a spray inlet opening 311 for receiving the spray 180 from the injector (not illustrated).

The mixing device 310 comprises a partially open wall 312 on a side upstream of the spray 180. In the illustrated case, the partially open wall 312 comprises a wall, e.g. a metal sheet, with perforations. Some or all of said perforations may be provided with louvers (not illustrated) to direct the gas flowing into the cavity in a particular direction so as to generate a swirling motion.

In the illustrated case, the partially open wall 312 at least partially follows a substantially conical surface parallel with the outer boundary of the intended spray pattern. Indeed, the perforated metal plate that serves as the partially open wall 312 generally defines a frustoconical surface, with the exception of the missing downstream portion which is to be closed by a closed wall 313, arranged on a side downstream of the spray 180.

The mixing device 310 further comprises an outlet opening 314 in a plane intersecting the axis S of the injector (when assembled). In the illustrated case, the outlet opening 314 is substantially perpendicular to an injection axis S of said injector. In the illustrated case, a spray disperser 325, such as a mesh (preferably a metal mesh), is arranged in the outlet opening 314.

The closed wall 313 and the partially open wall 312 together form a surface closed onto itself defining a mixing cavity. The injected spray 180 enters the mixing cavity through the inlet opening 311 and leaves the mixing cavity, mixed with the gas to be treated, through the outlet opening 314. The gas to be treated enters the mixing cavity through the openings of the partially open wall 312 on the upstream side of the mixing cavity, and leaves the mixing cavity enriched with the injected spray via the outlet opening 314.

A swirl promoting means 320 as described above is arranged downstream of the mixing device 310. In the illustrated example, it has a substantially planar body with an annular inlet zone consisting of openings that may be provided with louvers. In some embodiments of the mixing device according to the present invention, a downstream side of the mixing device is shaped so as to define a helicoidal groove for circumferentially guiding the gas from the outlet opening in a downstream direction. In the illustrated example, mixing device 310 (in particular the closed wall 313 and the baffle portions 313' that extend it) bends or tapers towards the upstream side in a direction approaching said spray inlet opening 311. This form aspect defines a substantially helicoidal open space between the mixing device 310 and the swirl promoting means 320 arranged just downstream of it, which serves as a guiding channel 400 allowing gas to flow from the outlet opening 314 to the annular inlet zone of the swirl promoting means 320.

The illustrated example includes the further optional feature that an upper portion of the surface of the mixing bowl 318 folds backwards (towards the downstream side), away from the general direction of the tapering, forming a funnel around the inlet opening (as seen from the upstream side) while forming part of a helicoidal groove (as seen from the downstream side) that defines a helicoidal space for circumferentially guiding the gas from the outlet opening in a downstream direction. In variants of the invention, this backward folded portion may extend further down again (towards the axis L of the main body), even to the extent that the helicoidal groove takes the form of a surface closed onto itself (i.e., rolled up with openings at its axial ends) defining a tube-like structure that delimits the helicoidal space. More generally, the helicoidal space may be delimited by any appropriate structure within or of a part with the closed wall 313 (i.e., an actual groove as such or any other suitably formed feature), either considered separately or in cooperation with another suitably arranged element downstream of the closed wall 313, such as the illustrated swirl promoting means 320.

In the absence of a cooperating element, the helicoidal space may be present between a form feature of the downstream side of the closed wall 313 (i.e., an actual groove as such or any other suitably formed feature) and a plane through the most downstream point of said downstream side, transverse to the axis L of the tubular chamber. Thus, in such cases, the downstream side of the closed wall 313 comprises a form feature such as a groove, which, relative to a transverse plane tangent to said downstream side, delimits a helicoidal space.

In the illustrated case, a restrictor arrangement 330 is provided downstream of the mixing device 310 and the swirl promoting means 320. The restrictor arrangement 330 may be a transverse plate provided with one or more openings. In an example, the restrictor arrangement 330 is a transverse plate provided with a circular central opening and a plurality of smaller openings arranged around the central opening. The or each opening may be a mere orifice, the axial extent of which is identical to the thickness of the plate, or its periphery may alternatively be provided with an axial protrusion of chosen length, which thus forms a tube protruding from the surface of the plate (not illustrated). The opening or pattern of openings leave the ring-shaped radially outer portion of the plate in place to block the gaseous flow from passing the restrictor arrangement 330 along the edge of the main body interior. Other shapes of the restrictor arrangement 330 may be used to obtain the same or substantially the same effect, such as (without limitation) a plurality of inwardly directed peripheral teeth.

Figure 6:
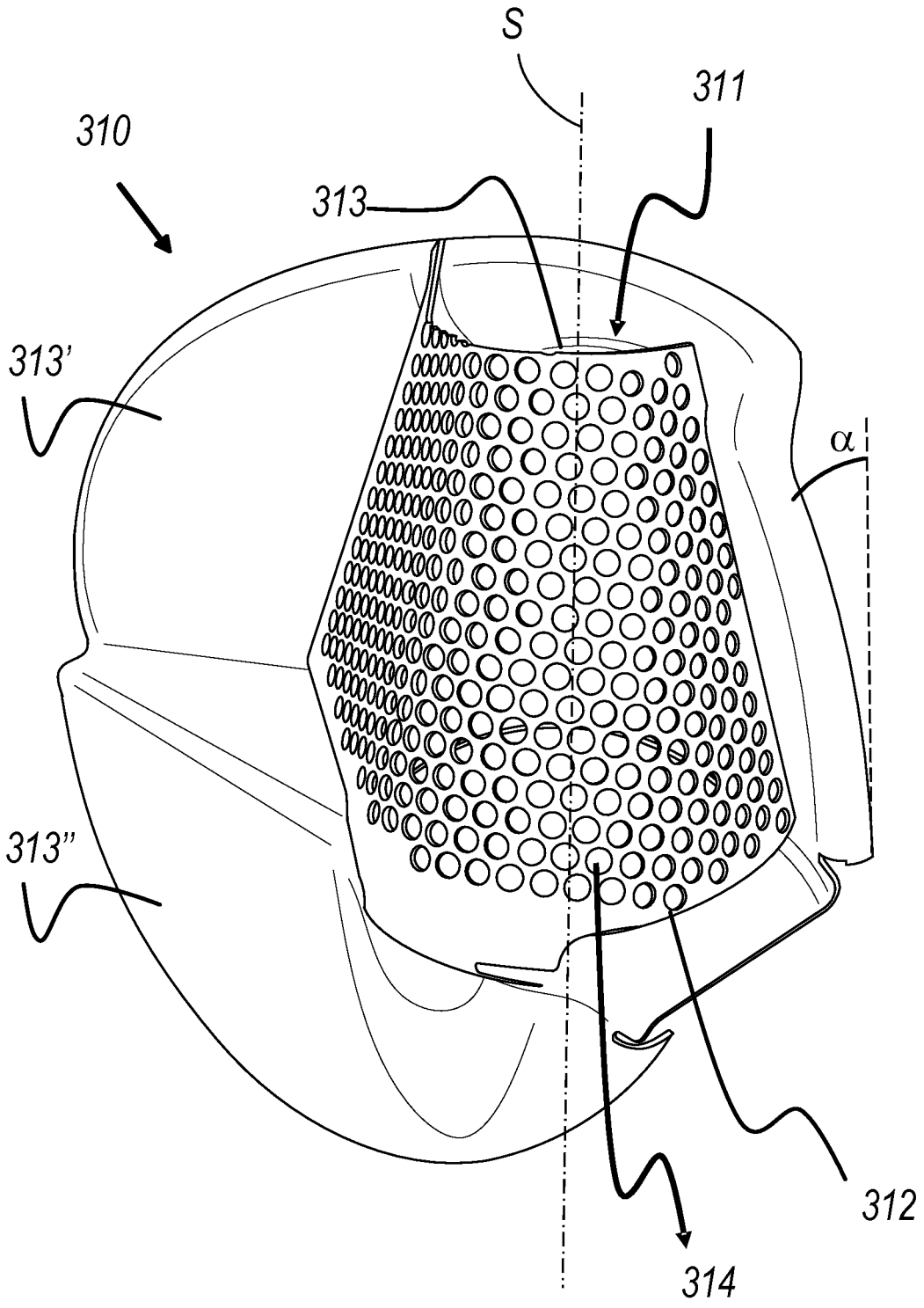
FIG. 6 presents details of the mixing device according to an embodiment of the present invention as included in FIGS. 4 and 5.

FIG. 6 presents details of the mixing device according to an embodiment of the present invention as included in FIGS. 4 and 5. The mixing device 310 of FIG. 6 is distinguished from the mixing device 310 of FIG. 3 by the shape of the partially open wall 312. As before, the shape of the partially open wall 312 partially follows the conical boundary of the injected spray. However, in this case, the partially open wall 312 joins the closed wall 313 at a point further removed from the axis S of the injector. As the partially open wall 312 and the mixing cavity are positioned away from the center of the substantially tubular chamber and do not cover its entire width, a portion of the oncoming gas flow will hit the surface of the baffle portions 313' on either side of the mixing cavity, and will be guided towards the mixing cavity by said surface. Being so guided, the gas will reach the portion of the partially open wall 312 near the closed wall 313 and enter the mixing cavity via the openings in the partially open wall 312. The partially unfolded arrangement of the present embodiment presents a larger number of perforations to the gas flow, thus facilitating the entrance of the gas flow into the mixing cavity.

Figure 7:
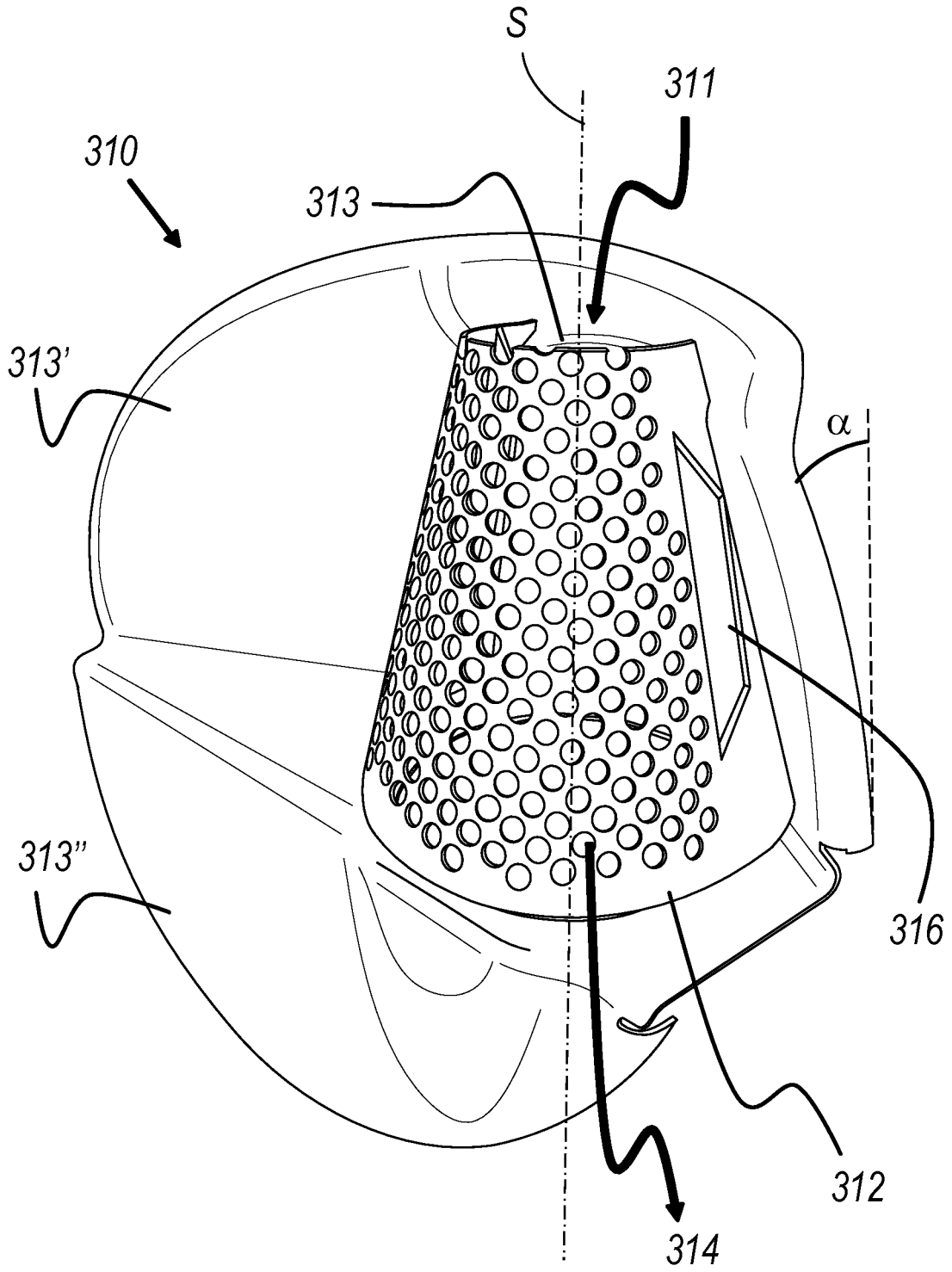
FIG. 7 presents details of the mixing device according to a third embodiment of the present invention.

FIG. 7 presents details of the mixing device according to a third embodiment of the present invention. The mixing device 310 of FIG. 7 is distinguished from the mixing device 310 of FIG. 3 by the shape of the partially open wall 312. As before, the shape of the partially open wall 312 partially follows the conical boundary of the injected spray. However, in this case, the partially open wall 312 is provided with additional louvers 316 in the zone proximate to the closed wall 313. As the partially open wall 312 and the mixing cavity are positioned away from the center of the substantially tubular chamber and do not cover its entire width, a portion of the oncoming gas flow will hit the surface of the baffle portions 313' on either side of the mixing cavity, and will be guided towards the mixing cavity by said surface. Being so guided, the gas will reach the portion of the partially open wall 312 near the closed wall 313 and enter the mixing cavity via the louvered slits 316.

Figure 8:
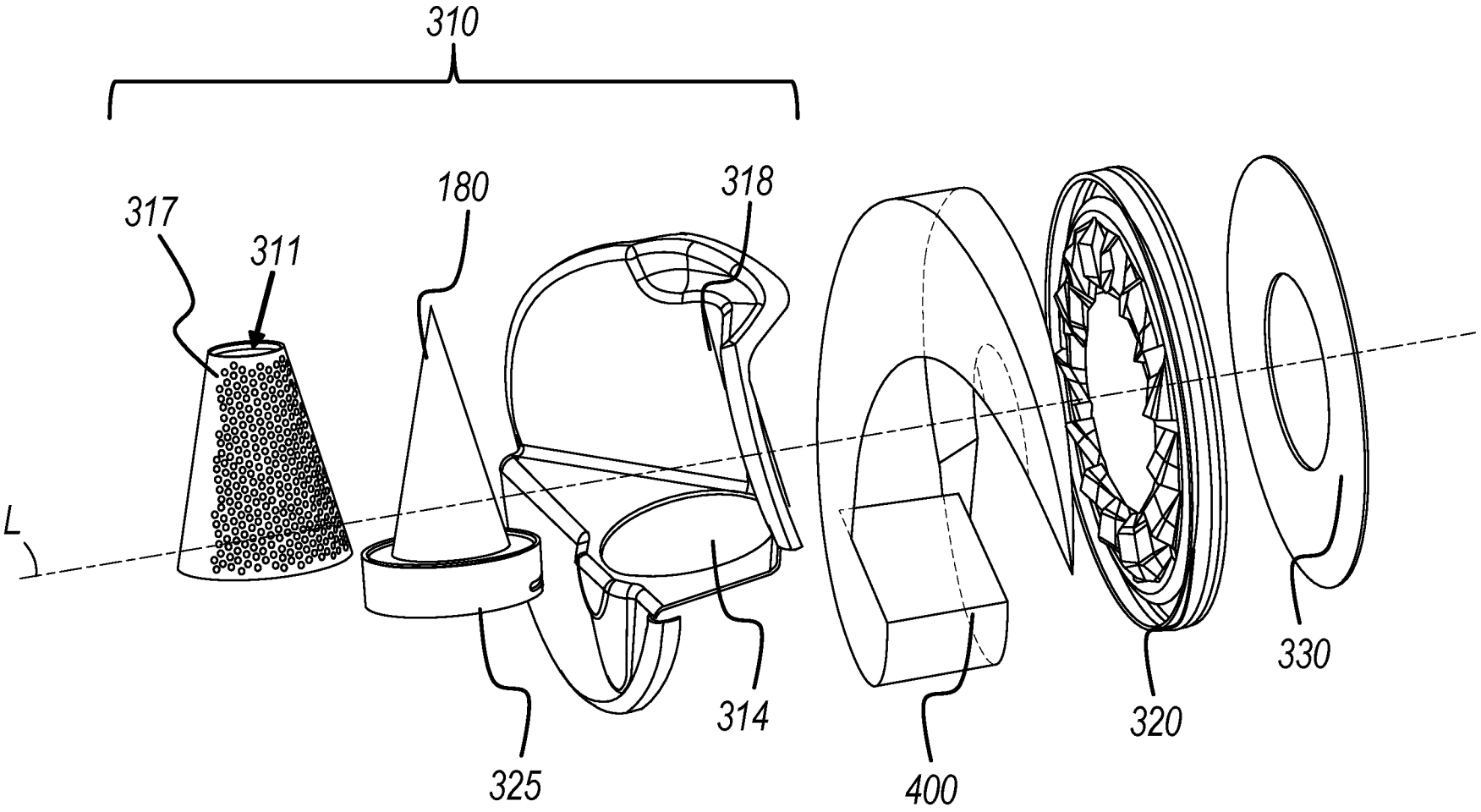
FIG. 8 presents an exploded view of a system for treating exhaust gas according to a fourth embodiment of the present invention.
Figure 9:
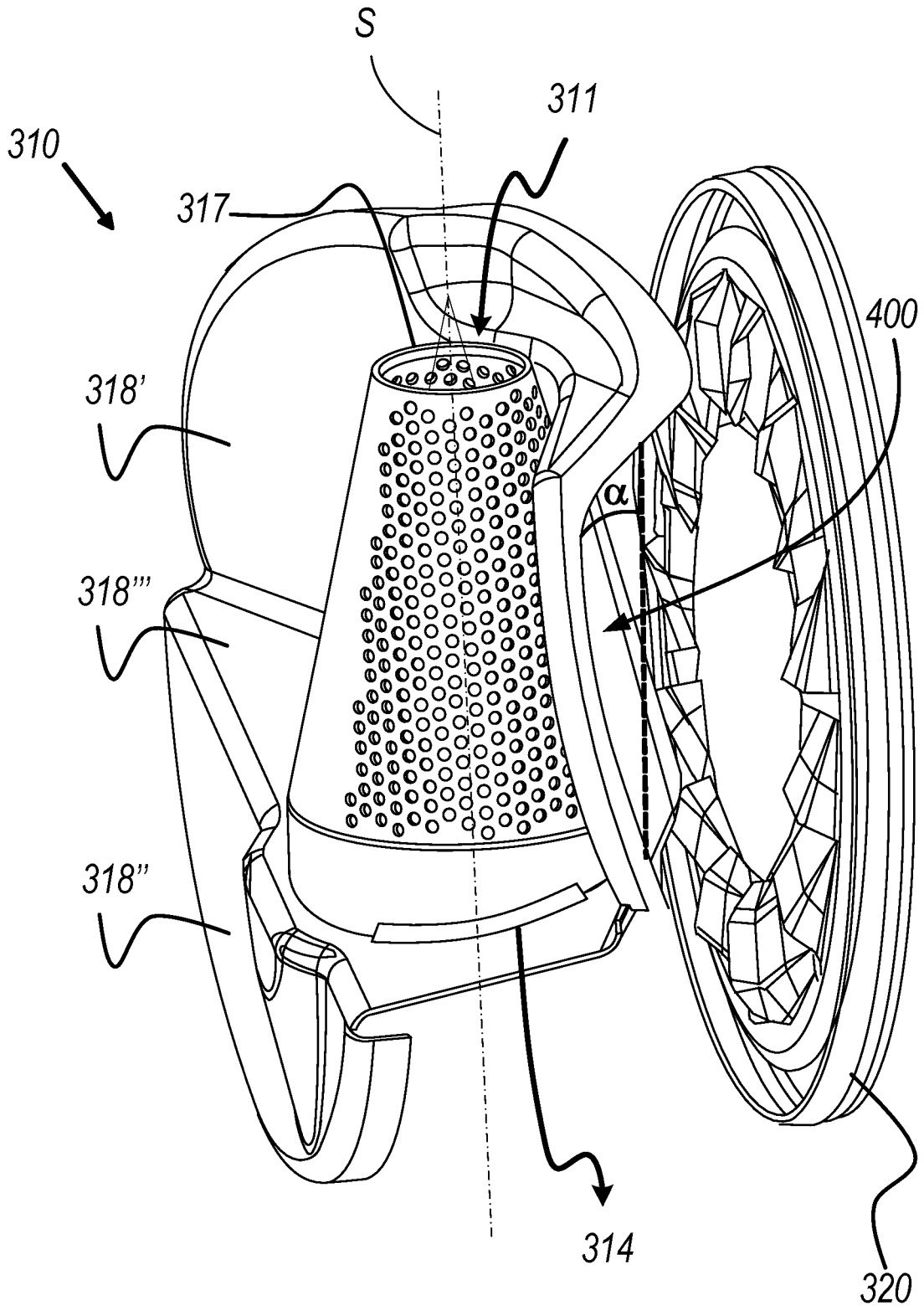
FIG. 9 presents details of the mixing device according to an embodiment of the present invention as included in FIG. 8.

FIGS. 8 and 9 present details of the mixing device according to a fourth embodiment of the present invention, exemplary of the embodiments in which the mixing device comprises a mixing cavity and a mixing bowl, wherein a downstream side of the mixing bowl is shaped so as to define a helicoidal groove for circumferential guiding the gas from the outlet opening in a downstream direction.

FIG. 8 presents an exploded view of a system for treating exhaust gas according to the fourth embodiment of the present invention.

As in FIG. 5, for clarity reasons, the main body has not been shown in FIG. 8. The reader will understand that the illustrated components fulfill their functions as described only when suitably arranged in a substantially tubular chamber that contains the gas flowing between the inlet side and the outlet side. As above, the terms "upstream" and "downstream" refer to the direction of flow of the gas to be treated inside the substantially tubular chamber (i.e., from left to right in the illustrated orientation).

The dosing arrangement is preferably configured so that an injection axis S of any injector mounted to the dosing arrangement is not coaxial with the longitudinal axis L of the main body.

The optional directional flow expansion device which may be present in the mixing region is not illustrated.

The components shown on the left-hand side of FIG. 8 combine to form a mixing device 310 for mixing a spray 180 from an injector into a gas flowing through the substantially tubular chamber from an upstream side to a downstream side. Without loss of generality, the spray 180 is illustrated as a conical spray.

When assembled, the mixing device 310 comprises a spray inlet opening 311 for receiving the spray 180 from the injector (not illustrated).

The mixing device 310 comprises a mixing cavity 317 and a mixing bowl 318. In the illustrated case, the mixing cavity 317 comprises a wall, e.g. a metal sheet, with perforations. Some or all of said perforations may be provided with louvers (not illustrated) to direct the gas flowing into the cavity in a particular direction so as to generate a swirling motion.

In the illustrated case, the mixing cavity 317 at least partially follows a substantially conical surface parallel with the outer boundary of the intended spray pattern. Indeed, the perforated metal plate that serves as the mixing cavity 317 generally defines a frustoconical surface. The perforations may be present over part or all of the entire surface of the mixing cavity 317. Other shapes of the mixing cavity and other distributions of the openings or perforations in the mantle are also in the scope of the present invention.

In the illustrated example, the perforations are present in those portions of the mantle that face the upper baffle portion (no. 318' in FIG. 9) of the mixing bowl 318, ensuring that the mixing cavity 317 primarily receives gas that has been deflected by said upper baffle portion. Accordingly, the mixing bowl 318 takes on the role of the closed wall of the previous embodiments, i.e. it blocks the gas flow from moving further downstream without passing through the mixing cavity and the outlet opening 314 provided in the mixing bowl 318, and guides gas towards the mixing cavity 317. The outlet opening 314 is preferably provided in a step portion (no. 318''' in FIG. 9) of the mixing bowl 318, in a plane intersecting the axis S of the injector (when assembled). In the illustrated case, the outlet opening 314 is substantially perpendicular to an injection axis S of said injector. In the illustrated case, a spray disperser 325, such as a mesh (preferably a metal mesh), is arranged in the outlet opening 314.

The injected spray 180 enters the mixing cavity 317 through the inlet opening 311 and leaves the mixing cavity 317, mixed with the gas to be treated, through the cavity's outlet opening (in the illustrated case, the open broad end at the bottom of the frustoconical tube), which is aligned with the outlet opening 314 of the mixing bowl 318. The gas to be treated enters the mixing cavity 317 through the perforations in the mantle, and leaves the mixing cavity enriched with the injected spray via the cavity's outlet opening, which is aligned with the outlet opening 314 of the mixing bowl 318.

A swirl promoting means 320 as described above is arranged downstream of the mixing device 310. In the illustrated example, it has a substantially planar body with an annular inlet zone consisting of openings that may be provided with louvers. In some embodiments of the mixing device according to the present invention, a downstream side of the mixing device is shaped so as to define a helicoidal groove for circumferentially guiding the gas from the outlet opening in a downstream direction. In the illustrated example, mixing device 310 (in particular the mixing bowl 318) bends or tapers towards the upstream side in a direction approaching said spray inlet opening 311. This form aspect defines a substantially helicoidal open space between the mixing device 310 and the swirl promoting means 320 arranged just downstream of it, which serves as a guiding channel 400 allowing gas to flow from the outlet opening 314 to the annular inlet zone of the swirl promoting means 320.

In the illustrated case, a restrictor arrangement 330 is provided downstream of the mixing device 310 and the swirl promoting means 320. The restrictor arrangement 330 may be a transverse plate provided with one or more openings. In an example, the restrictor arrangement 330 is a transverse plate provided with a circular central opening and a plurality of smaller openings arranged around the central opening. The or each opening may be a mere orifice, the axial extent of which is identical to the thickness of the plate, or its periphery may alternatively be provided with an axial protrusion of chosen length, which thus forms a tube protruding from the surface of the plate (not illustrated). The opening or pattern of openings leave the ring-shaped radially outer portion of the plate in place to block the gaseous flow from passing the restrictor arrangement 330 along the edge of the main body interior. Other shapes of the restrictor arrangement 330 may be used to obtain the same or substantially the same effect, such as (without limitation) a plurality of inwardly directed peripheral teeth.

FIG. 9 presents details of the mixing device according to an embodiment of the present invention as included in FIG. 8. As the mixing cavity 317 is positioned away from the center of the substantially tubular chamber and does not cover its entire width, a portion of the oncoming gas flow will hit the surface of the upper baffle portions 318' on either side of the mixing cavity 317, and will be guided towards the mixing cavity 317 by said surface. Being so guided, the gas will reach the perforated portion of the mantle of the mixing cavity 317 and enter through the perforations.

Like the closed wall 313 of FIGS. 3, 6, and 7, the bowl 318 bends or tapers towards the upstream side in a direction approaching said spray inlet opening 311, as schematically indicated by the identification of the gap □ between a vertical plane starting at the downstream side of the step portion 318''' of the bowl 318 (dashed line) and the position of the surface of the bowl 318 at a point closer to the inlet opening 311. This tapering contributes to the creation of the aforementioned helicoidal groove.

FIG. 9 further shows the further optional feature that an upper portion of the surface of the mixing bowl 318 folds backwards (towards the downstream side), away from the general direction of the tapering, forming a funnel around the inlet opening 311 of the mixing cavity 317 (as seen from the upstream side) while forming part of a helicoidal groove (as seen from the downstream side) that defines the aforementioned helicoidal space. In variants of the invention, this backward folded portion may extend further down again (towards the axis L of the main body), even to the extent that the helicoidal groove takes the form of a surface closed onto itself (i.e., rolled up with openings at its axial ends) defining a tube-like structure that delimits the helicoidal space. More generally, the helicoidal space may be delimited by any appropriate structure within or of a part with the mixing bowl 318 (i.e., an actual groove as such or any other suitably formed feature), either considered separately or in cooperation with another suitably arranged element downstream of the mixing bowl 318, such as the illustrated swirl promoting means 320.

In the absence of a cooperating element, the helicoidal space may be present between a form feature of the downstream side of the mixing bowl 318 (i.e., an actual groove as such or any other suitably formed feature) and a plane through the most downstream point of said downstream side, transverse to the axis L of the tubular chamber. Thus, in such cases, the downstream side of the mixing bowl 318 comprises a form feature such as a groove, which, relative to a transverse plane tangent to said downstream side, delimits a helicoidal space.

The present invention also pertains to an exhaust treatment device for treating exhaust comprising the system for treating an exhaust gas as described above, wherein an aftertreatment substrate (e.g. a Diesel particle filter, Selective Catalytic Reduction on Filter, or regular Selective Catalytic Reduction substrate) is disposed in the reaction zone 160, and wherein the inlet arrangement is adapted to receive an exhaust flow of an internal combustion engine. The liquid spray may consist of a urea solution (e.g. a eutectic urea/water solution, such as the ones commercially available under the names AdBlue and DEF).

The present invention also pertains to a motor vehicle comprising the exhaust treatment device described above, arranged for the purpose of treating the exhaust produced by the vehicle's internal combustion engine.

While the invention has been described hereinabove with reference to particular embodiments, this was done to clarify and not to limit the invention, the scope of which is to be determined by reference to the accompanying claims. In particular, variations and elements which have only been described in the context of a particular embodiment, may be combined with the features of other embodiments to obtain the same technical effects.

The invention claimed is:

1. A mixing device for mixing a spray from an injector into a gas flowing through a substantially tubular chamber from an upstream side to a downstream side, said mixing device comprising:

a partially open wall on a side upstream of said spray; and a closed wall on a side downstream of said spray;

said closed wall and said partially open wall together forming a surface closed onto itself defining a mixing cavity, wherein the closed wall is an integral part of a larger piece that also presents a baffle portion on either side of the mixing cavity, said mixing cavity comprising:

a spray inlet opening for receiving a conical spray from said injector; and an outlet opening in a plane intersecting an axis of said injector, and a skirt portion arranged directly upstream of a space below the outlet opening; and a downstream side of said mixing device being shaped so as to define a helicoidal groove for circumferentially guiding said gas from said outlet opening in a downstream direction.

2. The mixing device according to claim 1, wherein said partially open wall is permeable to gas.

3. The mixing device according to claim 1, wherein said partially open wall comprises a wall with perforations.

4. The mixing device according to claim 3, wherein at least some of said perforations are provided with louvers.

5. The mixing device according to claim 1, wherein said partially open wall at least partially follows a conical surface parallel with the outer boundary of said spray.

6. The mixing device according to claim 1, wherein said outlet opening is perpendicular to an injection axis of said injector.

7. The mixing device according to claim 1, further comprising a spray disperser arranged at said outlet opening.

8. The mixing device according to claim 7, wherein said spray disperser is a mesh.

9. The mixing device according to claim 1, wherein said closed wall bends or tapers towards the upstream side in a direction approaching said spray inlet opening.

10. The mixing device according to claim 1, wherein said mixing cavity is shaped as a cylindrical or frustoconical pipe with perforations in at least the partially open wall or as a cylindrically or frustoconically shaped mesh surface.

11. The mixing device according to claim 1, wherein the partially open wall and the closed wall are two separately formed pieces, distinct from any wall of the substantially tubular chamber and joined together so as to form the surface closed onto itself defining the mixing cavity.

12. A system for treating exhaust gas, the system comprising:

a substantially tubular chamber receiving a flow of exhaust gas to be treated;

a mixing device for mixing a spray from an injector into a gas flowing through a substantially tubular chamber from an upstream side to a downstream side, the mixing device including a partially open wall on a side upstream of said spray and a closed wall on a side downstream of said spray, the partially open wall and the closed wall being two separately formed pieces, distinct from any wall of the substantially tubular chamber and joined together so as to form a surface closed onto itself to define a mixing cavity, the mixing cavity including a spray inlet opening for receiving a conical spray from said injector and an outlet opening intersecting an axis of said injector;

an injector mounting location aligned with the spray inlet opening; and a swirl plate downstream of the mixing device, the swirl plate having an annular inlet zone;

the mixing device being shaped so as to open up a helicoidal space between the mixing device and the swirl plate, the helicoidal space serving as a flow channel from the outlet opening to the annular inlet zone.

13. The system according to claim 12, wherein an axis of the injector mounting location does not intersect with a longitudinal axis of the substantially tubular chamber.

14. The system according to claim 12, wherein the mixing device is arranged so as to substantially block any flows of gas from the upstream side to the downstream side other than flows entering said mixing device through the partially open wall and leaving the mixing device through the outlet opening.

15. The system according to claim 12, further comprising a swirl baffle downstream of said mixing device, wherein a part of said closed wall that is further removed from a longitudinal axis of said substantially tubular chamber is at a greater distance from the swirl baffle than a part of the closed wall that is closer to the longitudinal axis of the substantially tubular chamber.

16. A system for treating exhaust gas, the system comprising:

a substantially tubular chamber receiving a flow of exhaust gas to be treated;

a mixing device for mixing a spray from an injector into a gas flowing through the substantially tubular chamber from an upstream side to a downstream side, the mixing device including a partially open wall on a side upstream of said spray and a closed wall on a side downstream of said spray, the partially open wall and the closed wall being two separately formed pieces, distinct from any wall of the substantially tubular chamber and joined together so as to form a surface closed onto itself to define a mixing cavity, the mixing cavity including a spray inlet opening for receiving a conical spray from said injector and an outlet opening intersecting an axis of said injector;

a swirl plate downstream of the mixing device, the swirl plate having an annular inlet zone, wherein the mixing device is shaped so as to open up a helicoidal space between said mixing device and the swirl plate, the helicoidal space serving as a flow channel from said outlet opening to the annular inlet zone; and an injector mounting location aligned with the spray inlet opening.

* * * * *